US005370506A

United States Patent [19]

Fujii et al.

[11] Patent Number: 5,370,506

[45] Date of Patent: Dec. 6, 1994

[54] PISTON TYPE COMPRESSOR WITH A ROTARY SUCTION VALVE

[75] Inventors: Toshiro Fujii; Hiromi Kitayama; Koichi Ito; Hitoshi Inukai, all of Kariya, Japan

[73] Assignee: Kabushiki Kaisha Toyoda Jidoshokki Seisakusho, Kariya, Japan

[21] Appl. No.: 154,279

[22] Filed: Nov. 18, 1993

Related U.S. Application Data

[63] Continuation-in-part of Ser. No. 103,888, Aug. 6, 1993, abandoned.

[30] Foreign Application Priority Data

Nov. 19, 1992 [JP] Japan ..... 4-310648

[51] Int. Cl.[5] ..... F04B 1/12

[52] U.S. Cl. ..... 417/269; 137/246.23; 184/6.17

[58] Field of Search ..... 417/269; 91/484, 499, 91/502; 184/6.17; 137/625.11, 246.23, 246.12

[56] References Cited

U.S. PATENT DOCUMENTS

| | | | |
|---|---|---|---|
| 1,800,554 | 4/1931 | McKee | 137/246.23 |
| 1,925,378 | 9/1933 | Ferris et al. | 91/484 |
| 2,228,189 | 1/1941 | Waddell | 137/246.12 |
| 5,081,908 | 1/1992 | McBeth et al. | 91/499 |
| 5,232,349 | 8/1993 | Kimura et al. | 417/269 |

FOREIGN PATENT DOCUMENTS

| | | | |
|---|---|---|---|
| 1070890 | 6/1953 | Germany | 137/246.23 |
| 392587 | 4/1991 | Japan . | |

*Primary Examiner*—Richard A. Bertsch
*Assistant Examiner*—M. Kocharov
*Attorney, Agent, or Firm*—Brooks Haidt Haffner & Delahunty

[57] ABSTRACT

A piston type compressor has a plurality of cylinder bores in which a plurality of pistons reciprocate to effect suction, compression and discharge of refrigerant gas in response to rotation of a drive shaft. The compressor has a gas receiving chamber for receiving the refrigerant gas before compression, a discharge chamber for receiving the compressed gas, and at least one rotary valve mounted on the drive shaft to be rotatable with the drive shaft. The rotary valve has a suction passageway for providing fluid communication between the gas receiving chamber and each of the compression chambers formed in the cylinder bores. A groove is provided on the outer circumferential wall of the rotary valve. The groove is connected with the outlet of the suction passageway and extends to a vicinity of the opposing end portions along the outer circumferential wall. The groove supplies the lubricant oil within the refrigerant gas in the suction passageway to and between the outer circumferential wall of the rotary valve and the inner wall of the recessed chamber during the rotation of the rotary valve.

15 Claims, 8 Drawing Sheets

PISTON TYPE COMPRESSOR WITH A ROTARY SUCTION VALVE

This is a continuation-in-part of co-pending U.S. application Ser. No. 08/103,888 field on Aug. 6, 1993, now abandoned, which is incorporated herein by reference.

BACKGROUND OF THE INVENTION

1. Field of the Invention

The present invention relates to a reciprocating piston type refrigerant compressor provided with a refrigerant gas suction mechanism improved so as to increase the volumetric compression efficiency thereof.

2. Description of the Related Art

Various reciprocating piston type refrigerant compressors such as a swash plate operated reciprocating piston type refrigerant compressor, and a wobble plate operated reciprocating piston type refrigerant compressor are known.

Japanese Unexamined Patent Publication (KoKai) No. 3-92587 (JP-A-3-92587) discloses a typical conventional swash plate operated reciprocating piston type refrigerant compressor provided with a cylinder block having a plurality of axial cylinder bores in which pistons are axially reciprocated in response to the nutation of a swash-plate about the axis of rotation of its drive shaft. The swash-plate is housed in a swash plate chamber centrally formed in the cylinder block. The swash-plate chamber is also used for receiving refrigerant gas when it returns from the external refrigeration circuit.

The above-mentioned compressor is further provided with flapper type suction valves which are used to open and close suction ports arranged between respective compression chambers defined by the reciprocating pistons in the cylinder bores and a pair of suction chambers (the front and rear suction chambers) for receiving the refrigerant gas before compression, and fluidly communicated with the above-mentioned swash plate chamber via suction passageways. The refrigerant gas before compression is drawn into respective compression chambers through the suction ports via the opening flapper type suction valves during the suction stroke of respective reciprocating pistons moving from the top dead center to the bottom dead center thereof. When respective reciprocating pistons implement the compression and discharge stroke thereof by moving from the bottom dead center to the top dead center thereof in the cylinder bores, respectively, the flapper type suction valves are closed. The refrigerant gas is compressed in the compression chamber, and discharged therefrom into a pair of discharge chambers (the front and rear discharge chambers) via the opening flapper type discharge valves which arranged so as to open and close discharge ports formed between the compression chambers and the discharge chambers.

The opening and closing of the flapper type suction valves are caused by a pressure differential between the suction chambers and respective compression chambers in the cylinder bores. Namely, when pressure prevailing in the suction chambers is higher than that in the compression chambers due to the suction stroke of the reciprocating pistons, the flapper type suction valves are bent by the pressure differential to move toward the opening position thereof opening the suction ports.

Since the flapper type suction valves are made of elastic material to show resilience when bending, such resilience of the flapper type suction valves acts as an elastic resistance against movement of respective suction valves. Accordingly, the opening of the flapper type suction valves does not occur before the above-mentioned pressure differential between the suction chambers and the compression chambers becomes larger than a predetermined level. Thus, the motion of opening of the flapper-type valves cannot be quick enough for achieving an instant suction of the refrigerant gas into the compression chambers.

Further, the above-described piston type compressors are generally supplied with a lubricating oil in the form of oil mist suspended in the refrigerant gas in order to lubricate the internal elements of the compressor. Thus, the lubricating oil suspended in the refrigerant gas is distributed to many of the internal portions of the compressor by flowing together with the refrigerant gas. As a result the lubricating oil, suspended in the refrigerant gas as an oil mist, can be carried toward and attach to faces of the flapper type suction valves as well as wall portions surrounding the suction ports and contacted by the flapper type suction valves. Thus, when the lubricating oil attaches to the flapper type suction valves and the wall portions surrounding the suction ports, it is so viscous as to prevent quick opening of the flapper type suction valves from the closing position thereof contacting the wall portions. Accordingly, the quick opening of the flapper type suction valves is prevented due to the attachment of the lubricating oil to both the flapper-type suction-valves and the wall portions.

Since the flapper type suction valves of the conventional refrigerant compressor are not able to open quickly in response to a pressure differential between the suction chambers and the compression chambers, the amount of flow of the refrigerant gas from the suction chambers into the compression chambers is reduced, and accordingly, the volumetric efficiency in the compression of the refrigerant gas by the conventional reciprocating piston type refrigerant compressor using the flapper type suction valves is made small. Furthermore, when the flapper type suction valves are opened so as to permit suction of the refrigerant gas into the compression chambers, the resilience of the suction-valves per se acts as resistance against the suction of the refrigerant gas, and thus, the amount of suction of the refrigerant gas is further reduced.

In the described conventional swash plate operated reciprocating piston type compressor, the plurality of axial cylinder bores of the cylinder block are arranged around the axis of rotation of the drive shaft with an equiangular distance between the two neighboring cylinder bores. Nevertheless, when the angular distance between the two neighboring cylinder bores is set small, the thickness of a separating rigid portion between the two neighboring cylinder bores is reduced to thereby weaken the physical strength of the cylinder block. Moreover, when the suction passageways for the refrigerant gas flow from the swash plate chamber to the suction chambers are provided in the separating rigid portions as disclosed in JP-A-3-92587, the formation of such suction passageways will further weaken the physical strength of the cylinder block.

When the angular distance between the two neighboring cylinder bores is set large to obtain a thick separating rigid portion in the cylinder block, respective cylinder bores must be arranged along a circle having a large radius about a center lying in the axis of rotation of the drive shaft. Therefore, such large radius of the circle along which the cylinder bores are arranged will bring about an increase in the physical size of the compressor.

Nevertheless, when the radius of the circle along which the cylinder bores are arranged is made small to reduce the diametrical size of the cylinder block, the angular distance between the two neighboring cylinder bores must be necessarily reduced, and accordingly, the circumferential thickness of respective rigid portions between the two neighboring cylinder bores is reduced to thereby weaken the physical strength of the cylinder block, as described before. Consequently, it is difficult to reduce the size of the compressor.

In addition, the provision of the suction passageways in the rigid portions between the two neighboring cylinder bores of the cylinder block is apt to cause loss of pressure of the compressed refrigerant gas, and accordingly, the compression efficiency of the compressor is further reduced. A reciprocating piston type compressor is described in copending U.S. Application Ser. No. 08/103,888 in which volumetric compression efficiency is significantly improved. In the compressor described therein, a rotary valve is mounted on a drive shaft. A suction passageway for introducing refrigerant gas into compression chambers in associated cylinder bores is formed in the rotary valve. A circumference of the rotary valve is axially slanted. An inner wall of a receiving chamber which accommodates the rotary valve is also axially slanted. The rotary valve is slidable along the axial direction. Air tight sealing between the outer circumference of the rotary valve and the inner wall of the receiving chamber is effectively achieved by urging the rotary valve from a large diameter side to a small diameter side thereof. The compression chambers successively communicate with the suction passageway synchronously with reciprocal motion of pistons which results in rotation of he rotary valve.

However, since most of the area of the outer circumference of the rotary valve is consistently urged against the inner wall of the receiving chamber in the compressor, the lubricant oil that is mixed with the refrigerant gas may not be sufficient to adequately lubricate the slidably contacting portion therebetween. Inadequate lubrication prevents smooth rotation of the rotary valve and may result in excessive wear or even catastrophic failure.

SUMMARY OF THE INVENTION

A primary object of the present invention is to provide a reciprocating piston type refrigerant compressor having a high volumetric efficiency in the compression of the refrigerant gas, to provide for reducing the diameter of the compressor so as to achieve overall downsizing thereof.

A further object of the present invention is to provide a mechanism for guiding refrigerant gas used in a reciprocating piston type refrigerant compressor to provide adequate lubrication at the slidably contacting portion between the outer circumference of the rotary valve and the inner wall of the receiving chamber which receives the rotary valve.

To achieve the above objects, a compressor according to the present invention has a body and a drive shaft rotatably supported in the body. At least one gas receiving chamber is formed in the body for receiving refrigerant gas mixed with lubricant oil before compression. At least one gas discharge chamber is formed in the body for receiving compressed refrigerant gas. The body has a plurality of axial cylinder bores disposed radially about an axis of rotation of the drive shaft. A plurality of reciprocating pistons are slidably received in the plurality of cylinder bores and reciprocated in response to the rotation of the drive shaft. The reciprocating pistons define compression chambers in the cylinder bores.

A rotary valve means having an outer circumferential wall and opposing end portions is arranged to be rotatable with the drive shaft and is rotatably disposed within a recessed chamber of the body. The recessed chamber is surrounded by an inner wall circumferentially extending around the axis of rotation of the drive shaft. The outer circumferential wall of the rotary shaft is slidably fitted within the inner wall of the recessed chamber.

A suction passageway is formed in the rotary valve means. The suction passageway permits suction of non compressed refrigerant gas from the receiving chamber into the respective compression chambers during rotation of the rotary valve means. The suction passageway has an inlet located at the gas receiving chamber side and an outlet located at the compression chambers side on the outer circumferential wall of the rotary valve. A groove is provided on the outer circumferential wall of the rotary valve means. The groove is connected with the outlet of the suction passageway and extends to a vicinity of the opposing end portions along the outer circumferential wall. The groove supplies the lubricant oil in the refrigerant gas in the suction passageway between the outer circumferential wall of the rotary valve means and the inner wall of the recessed chamber during the rotation of the rotary valve means.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings, in which:

DETAILED DESCRIPTION OF THE PREFERRED EMBODIMENTS

Figure 1:
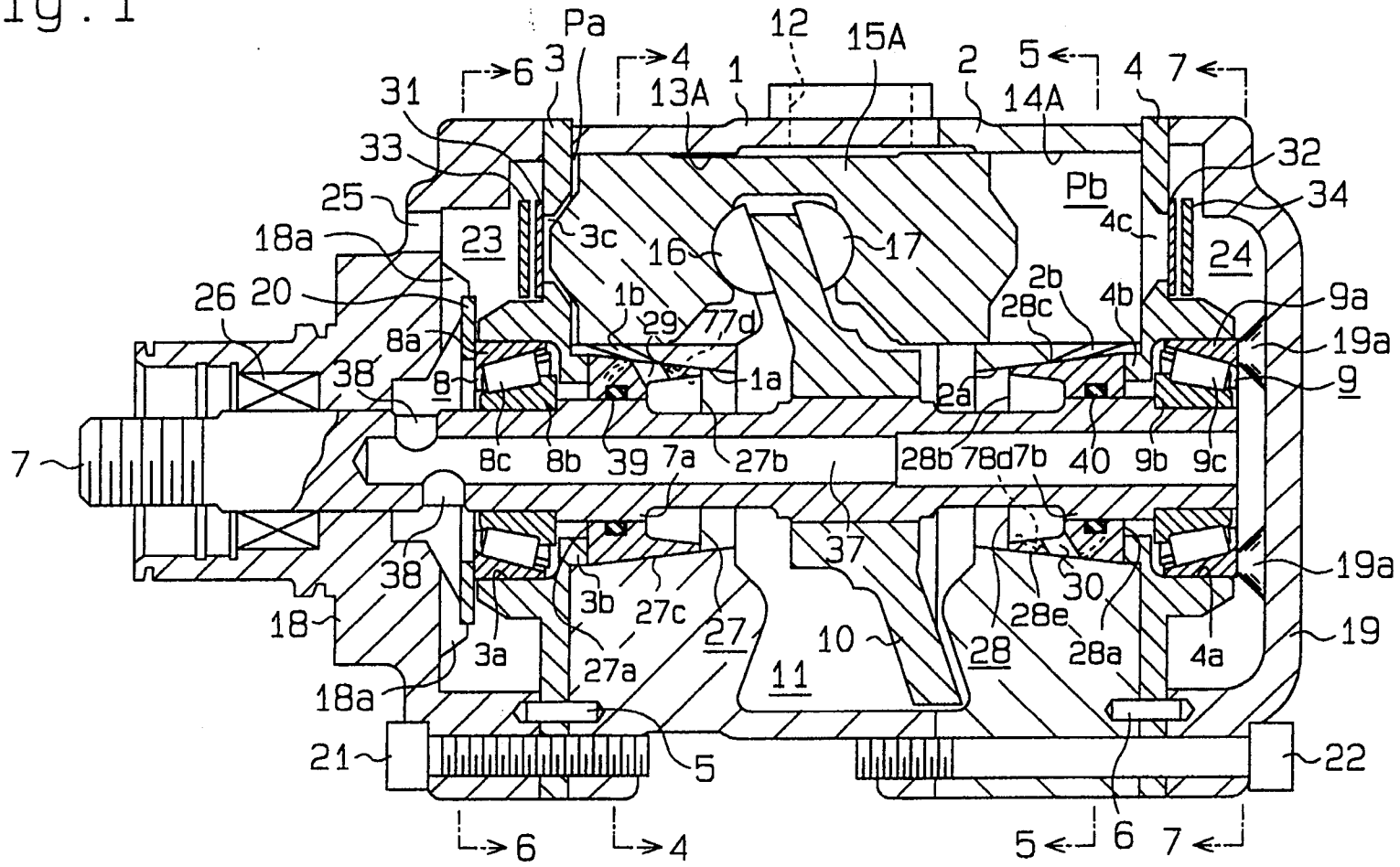
FIG. 1 is a longitudinal cross sectional view of an entire compressor according to a first embodiment of the present invention.

Referring to FIG. 1, the reciprocating-piston-type compressor is provided with a pair of front and rear cylinder blocks 1 and 2 combined together to form a main part of an axially extending compressor body. The cylinder blocks 1 and 2 of the body are centrally formed with later described valve receiving chambers 1*a* and 2*a* in the form of a conically recessed through bore, respectively.

The connected cylinder blocks 1 and 2 have an axially opposite ends, i.e., front and rear (left hand and right hand) ends to which front and rear valve plates 3 and 4 are air-tightly attached, respectively. The front and rear valve plates 3 and 4 are centrally provided with respective boss portions in which bearing receipt bores 3*a* and 4*a* in the form of a through-bore are formed, respectively. The valve plates 3 and 4 are also centrally provided with annular positioning projections 3*b* and 4*b*, respectively, which axially inwardly project so as to be engaged in the lip of the valve receiving chambers 1*a* and 2*a* of the front and rear cylinder blocks 1 and 2. The annular positioning projections 3*b* and 4*b* are formed so as to be substantially coaxial with the bearing receipt bores 3*a* and 4*a*, respectively. The valve plates 3 and 4 are fixed to the ends of the connected cylinder blocks 1 and 2 by pins 5 and 6, respectively, so that both valve plates 3 and 4 cannot be rotated with regard to the cylinder blocks 1 and 2.

An axial drive shaft 7 extends through the center of the connected cylinder blocks 1 and 2, and is rotatably supported by tapered-roller bearings 8 and 9 received in the above-mentioned bearing receipt bores 3*a* and 4*a* of the front and rear valve plates 3 and 4, respectively. The tapered roller bearings 8 and 9 are provided with outer races 8*a* and 9*a*, inner races 8*b* and 9*b*, and a plurality of tapered rollers 8*c* and 9*c*, and are able to accept both radial and thrust forces.

A swash plate 10 is fixedly mounted on the drive shaft 7 so that the swash plate 10 is rotated together with the drive shaft 7 in a swash plate chamber 11 which is axially centrally formed in the connected cylinder blocks 1 and 2. The cylinder blocks 1 and 2 are also provided with gas inlet ports 12 formed in the axially central portion of the cylinder blocks 1 and 2 so as to be communicated with the swash-plate chamber 11, and the gas inlet port 12 are connected to a gas inlet pipe of an external refrigerating circuit when the compressor is incorporated in the refrigerating system.

Figure 4:
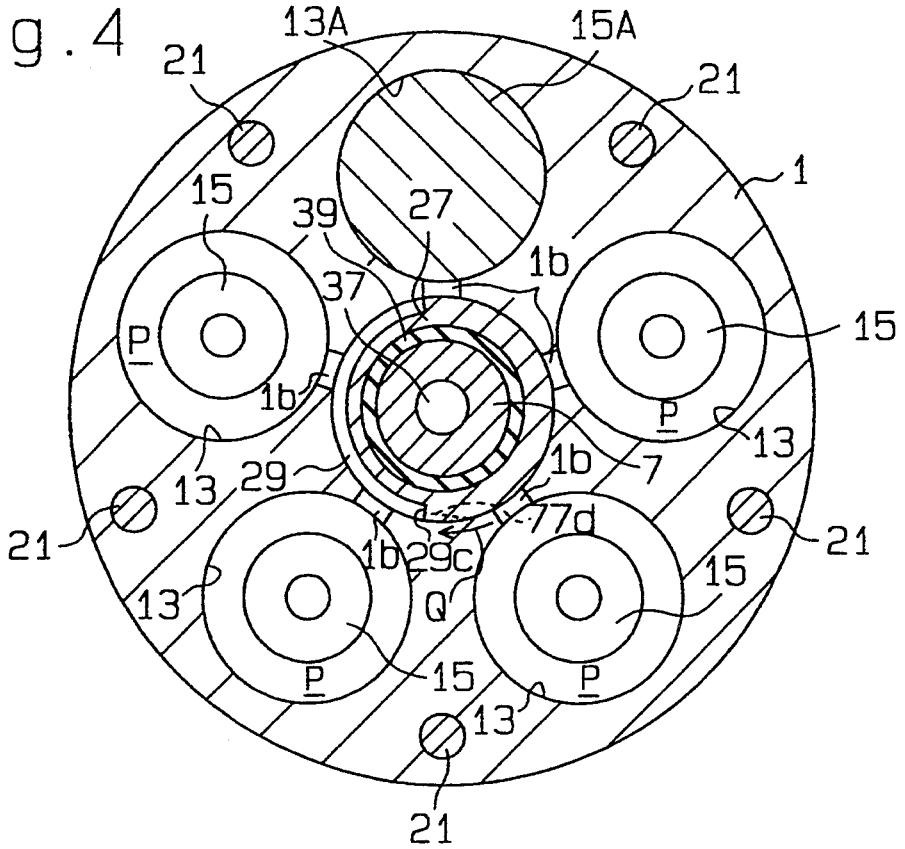
FIG. 4 is a cross sectional view of the compressor taken along the line IV—IV of FIG. 1.
Figure 5:
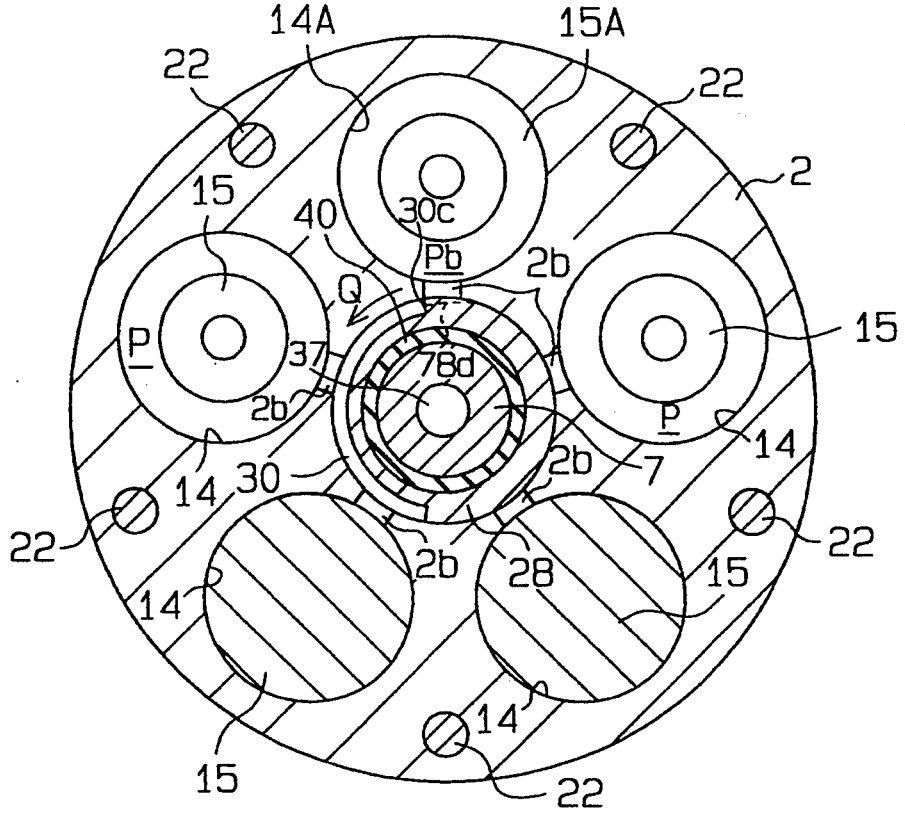
FIG. 5 is a cross sectional view of the compressor taken along the line V—V of FIG. 1.

The front cylinder block 1 is provided with a plurality of cylinder bores 13, and the rear cylinder block 2 is provided with a plurality of cylinder bores 14. The cylinder bores 13 and 14 are axially aligned to form a plurality of pairs (five pairs in the illustrated embodiment), and the plurality of pairs of cylinder bores 13 and 14 are equiangularly arranged around an axis of rotation of the drive shaft 7, as best shown in FIGS. 4 and 5. It should be noted that the cylinder bores out of the plurality of cylinder bores 13 and 14 shown in FIG. 1 in addition to FIGS. 4 and 5 are particularly designated by reference numerals 13A and 14A, respectively.

In each of the pairs of cylinder bores 13, 14, 13A and 14A, a reciprocatory double headed piston 15 (the piston in the cylinder bores 13A and 14A is designated by 15A) is received so as to be moved in a reciprocating manner. Each of the double headed pistons 15, 15A is centrally engaged with both faces of the swash plate 10 via a pair of semispherical shoes 16 and 17, and accordingly, when the swash plate 10 is rotated together with the drive shaft 7, the pistons 15, 15A are axially reciprocated in respective cylinder bores 13, 14, 13A and 14A.

A front housing 18 is air-tightly attached to the outer face of the front valve plate 3, and a rear housing 19 is air-tightly attached to the outer face of the rear valve plate 4.

Figure 6:
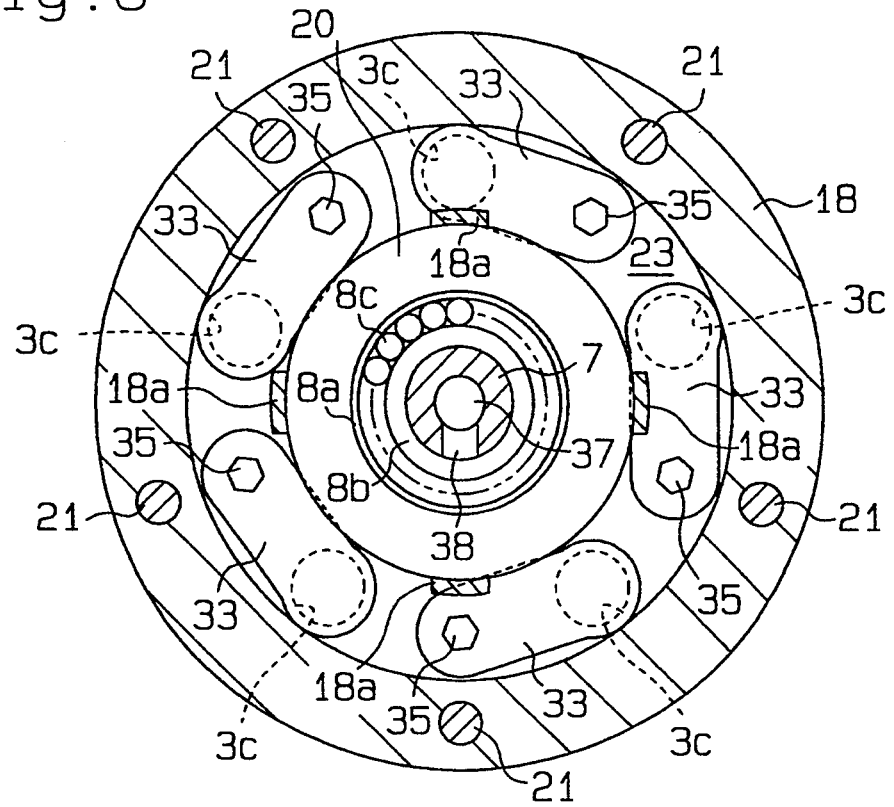
FIG. 6 is a cross sectional view of the compressor taken along the line VI—VI of FIG. 1.
Figure 7:
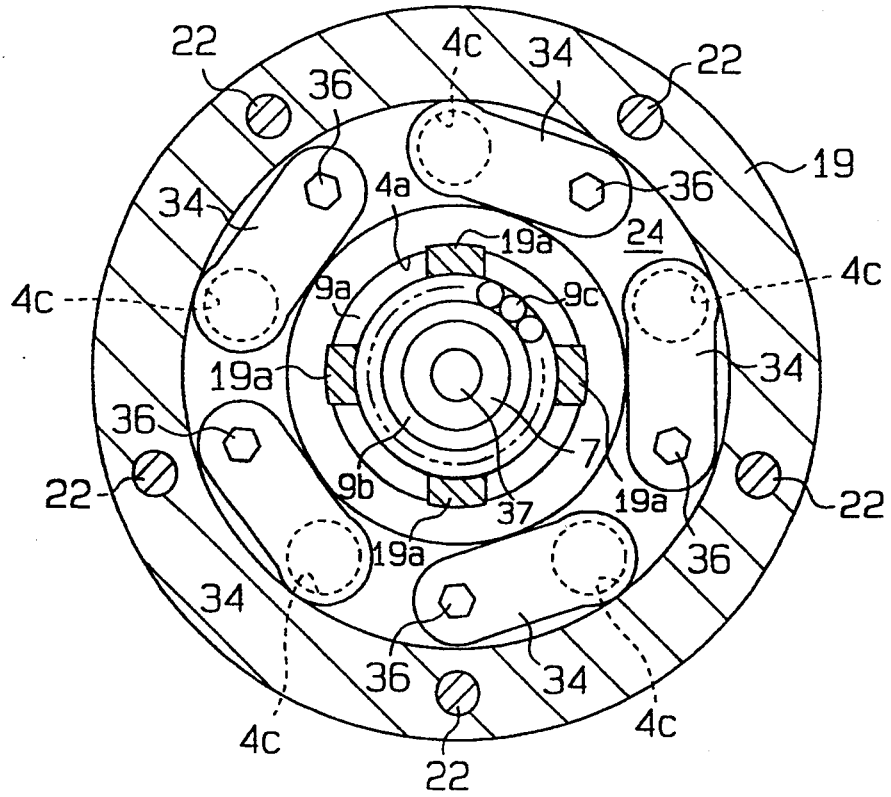
FIG. 7 is a cross sectional view of the compressor taken along the line VII—VII of FIG. 1.

The front and rear housings 18 and 19 are provided with a plurality of support projections 18*a* and 19*a*, respectively, which inwardly project from respective inner faces of both housings 18 and 19. The arrangement of the support projections 18*a* and 19*a* is best shown in FIGS. 6 and 7, respectively.

The support projections 18*a* of the front housing 18 axially support the outer race 8*a* of the front tapered roller bearing 8 via an annular-shape leaf spring 20 which applies a preload to the outer race 8*a* of the bearing 8. The support projections 19*a* of the rear housing 19 are directly engaged with the outer race 9*a* of the rear tapered-roller bearing 9.

The inner races 8*b* and 9*b* of the tapered-roller bearings 8 and 9 bear against shoulders of annular raised portions 7*a* and 7*b* of the drive shaft 7, respectively.

The front cylinder block 1, the front valve plate 3 and the front housing 18 are tightly connected together by screw bolts 21. When screwing the screw bolts 21, the leaf spring 20 is bent to thereby apply a preload to the front tapered-roller bearing 8, and accordingly, the preload is transmitted to the rear tapered-roller bearing 9 via the drive shaft 7. Namely, the drive shaft 7 is stably rotated due to the support of both tapered roller bearings 8 and 9.

The front and rear cylinder blocks 1 and 2, the rear valve plate 4, and the rear housing 19 are tightly connected together by long screw bolts 22. Thus, the front and rear cylinder blocks 1 and 2, the front and rear valve plates 3 and 4, and the front and rear housings 18 and 19 constitute the body of the compressor.

The front and rear housings 18 and 19 of the compressor body are internally provided with discharge chambers 23 and 24, respectively. The discharge chambers 23 and 24 fluidly communicate with compression chambers Pa and Pb formed in respective pairs of cylinder bores 13 and 14, 13A and 14A via discharge ports 3*c* and 4*c* provided in the front and rear valve plates 3 and 4. The compression chambers Pa and Pb of each pair of cylinder bores 13 and 14, e.g., 13A and 14A are defined by the double-headed piston 15, e.g., 15A (FIG. 1) as variable volume chambers in the cylinder bores 13A and 14A, and are in axial registration with the discharge ports 3*c* and 4*c*, respectively. Therefore, in the first embodiment shown in FIGS. 1 through 7, five front and five rear discharge ports 3*c* and 4*c* are formed in the front and rear valve plates 3 and 4, respectively. These discharge ports 3*c* and 4*c* are closed by flapper-type discharge valves 31 and 32, respectively, which are opened by the high pressure of the compressed refrigerant gas at final stage of compression of the refrigerant gas by the double headed pistons 15, 15A. The discharge valves 31 and 32 are backed up by retainers 33 and 34, respectively, which determine the amount of opening of the flapper-type discharge valves 31 and 32. The discharge valves 31 and 32 and the retainers 33 and 34 are firmed by screw bolts 35 and 36 (FIGS. 6 and 7) to the front and rear valve plates 3 and 4, respectively. As shown in FIG. 1, the front discharge chamber 23 is communicated with the external refrigerating circuit via an outlet port 25 formed in the front housing 18.

The element designated by reference numeral 26 is a lip seal arranged around a front portion of the drive shaft 7 so as to prevent the compressed refrigerant gas from leaking from the discharge chamber 23 toward the outside of the compressor.

A pair of rotary valve elements 27 and 28 are mounted on the drive shaft 7 at the annular raised portions 7*a* and 7*b* thereof so as to be rotated together with the drive shaft 7 within the aforementioned valve receiving chambers 1*a* and 2*a* in a direction Q shown in FIGS. 4 and 5. The rotary valve elements 27 and 28 are also permitted to slightly move on the drive shaft 7 in the axial direction.

Seal rings 39 and 40 are arranged between the central inner bores 27*f* and 28*f* of respective rotary valve elements 27 and 28 and the outer circumference of the raised portions 7*a* and 7*b* of the drive shaft 7 so as to provide an air-tight condition therebetween.

Figure 2:
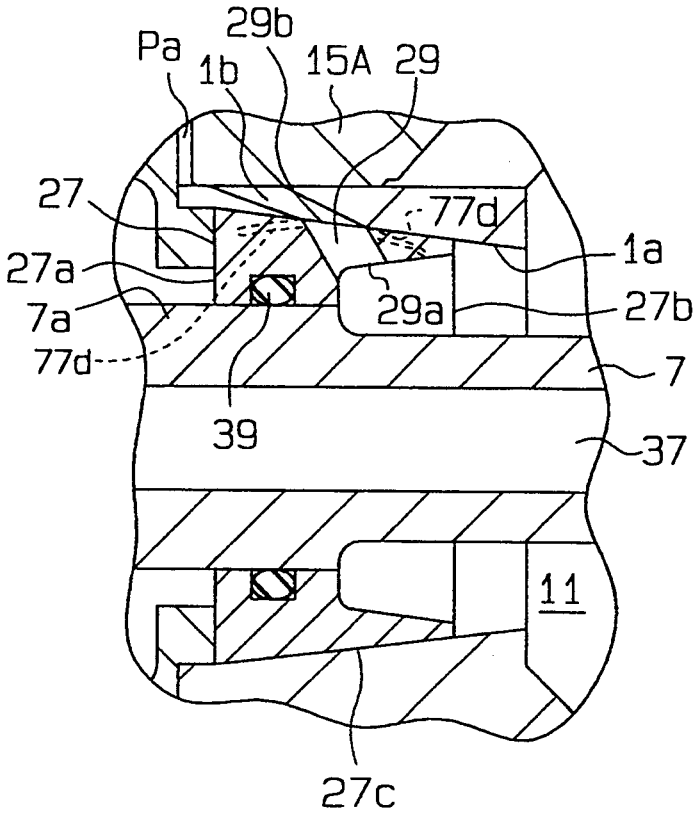
FIG. 2 is a partially enlarged cross sectional view of the compressor of FIG. 1.

As typically shown in FIG. 2, the valve receiving chamber 1*a* of the front cylinder block 1 is formed as an axially slanted or tapered bore having a cylindrical inner wall axially converging from the left-hand end of the cylinder block 1 toward the center of the compressor body. The valve receiving chamber 2*a* of the rear cylinder block 2 has a similar construction to that of the above-mentioned valve receiving chamber 1*a*.

The rotary valve elements 27 and 28 are provided with tapered outer circumferences 27*c* and 28*c*, respectively, which can be complementarily fitted in the converging inner walls of the valve receiving chambers 1*a* and 2*a*. Namely, as will be understood from FIG. 2, one of the rotary valve elements 27 and 28, i.e., the rotary valve element 27 is arranged in such a manner that an end 27*a* of a large diameter portion thereof is directed toward the front discharge chamber 23, and an end 27*b* of a small diameter portion thereof is directed toward the swash-plate chamber 11. It should be understood that the rotary valve element 28 is similarly arranged. Thus, an end 28*a* of a large diameter portion of the valve element 28 is directed toward the rear discharge chamber 24, and an end 28*b* of a small diameter portion of the valve element 28 is directed toward the swash plate chamber 11.

As shown in FIGS. 1 and 2, the rotary valve elements 27 and 28 are provided with suction passageways 29 and 30, respectively, which have inlets 29*a* and 30*a* opening toward the small diameter ends 27*b* and 28*b*, and outlets 29*b* and 30*b* opening in the tapered outer circumferences 27*c* and 28*c*, respectively.

Figure 3:
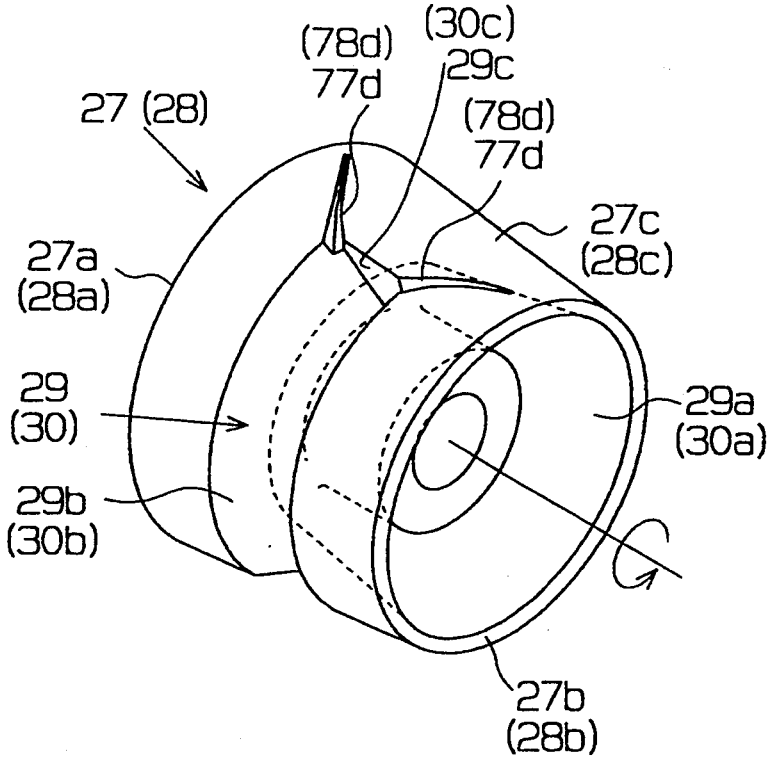
FIG. 3 is a perspective view of a rotary valve element of FIGS. 1 and 2.

Referring now to FIG. 3, there are shown a pair of lubricant passageways 77*d* formed in a tapered outer circumference 27*c* of the rotary valve element 27 having a large diameter end portion 27*a* and a small diameter end portion 27*b*. Each of the lubricant passageways 77*d* is slanted and extends outward from each end of suction passageway 29 in the direction of rotation of rotary valve element 27 toward large diameter end portion 27*a* and small diameter end portion 27*b*, respectively. The passageways 77*d* terminate before reaching large and small diameter end portions 27*a* and 27*b*, respectively.

Referring now to FIGS. 1, 2 and 3, the rotary valve element 27 rotates, the lubricant oil adhered on the inner circumference of the receiving chamber 1*a* is gathered by the outer edge portion of a rear end surface 29*c* on the rear end surface 29*c* of the suction passageway 29 and in the suction passageway 29. The lubricant oil gathered in the suction passageway 29 is sufficiently supplied through lubricant passageways 77*d* to almost the entire circumference 27*c* of the rotary valve element 27 and to the inner circumference of the receiving chamber 1*a* with which the outer circumference 27*c* continually slidably contacts. Therefore, according to this structure, lubrication to the rotary valve element 27 is efficiently carried out.

Referring again now to FIG. 3, similar to the rotary valve element 27, a pair of lubricant passageways 78*d* are also formed in a tapered outer circumference 28*c* of the rotary valve element 28. Each of the passageways 78*d* extends outward from each end of suction passageway 30 in the direction of rotation of rotary valve element 28 toward a large diameter end portion 28*a* and a small diameter end portion 28*b*. The lubricant oil is sufficiently supplied between the outer circumference 28*c* of the rotary valve element 28 and the inner circumference of the receiving chamber 2*a* through the lubricant passageways 78*d*.

As shown in FIG. 4, the inner wall of the receiving chamber 1*a* is provided with suction ports 1*b*, the number of which is identical with the number of cylinder bores 13 and 13A. The suction ports 1*b* are arranged equiangularly so that one of the suction ports 1*b* opens toward one of the cylinder bores 13 and 13A. In this manner respective suction ports 1*b* may be successively communicated with an outlet 29*b* of the suction passageway 29, and so that each one of the cylinder bores 13 and 13A can be successively communicated with a swash plate chamber 11 in response to the rotation of the rotary valve element 27.

Similarly, as shown in FIG. 5, the inner wall of the receiving chamber 2*a* is provided with suction ports 2*b* the number of which is identical with the number of cylinder bores 14 and 14A. The suction ports 2*b* are arranged equiangularly so that one of the suction ports 2*b* opens toward one of the cylinder bores 14 and 14A. In this manner respective suction ports 2*b* may be successively communicated with an outlet 30*b* of the suction passageway 30, so that each one of the cylinder bores 14 and 14A can be successively communicated with the swash plate chamber 11 in response to the rotation of rotary valve element 28.

As shown in FIGS. 1, 4 and 5, one of the plurality of double headed reciprocating pistons 15, i.e., the piston 15A is moved to a position corresponding to the top dead center thereof with regard to the cylinder bore 13A, and accordingly, to the bottom dead center thereof with regard to the cylinder bore 14A. When the double headed piston 15A is reciprocated and moves from the shown top dead center toward the bottom dead center thereby carrying out the suction stroke for the cylinder bore 13A, the suction passageway 29 is communicated with the compression chamber Pa of the cylinder bore 13A. Accordingly, the refrigerant gas before compression in the swash plate chamber 11 is drawn into the compression chamber Pa of the cylinder bore 13A through the suction passage 29.

While the double headed reciprocating piston 15A is carrying out the suction stroke thereof with regard to the cylinder bore 13A, the same piston 15A discharges the cylinder bore 14A by moving from the bottom dead center to the top dead center within the cylinder bore 14A. During the discharge stroke the piston 15A with regard to the cylinder bore 14A, communication between the compression chamber Pb of the cylinder bore 14A and the swash plate chamber 11 through suction passage 30 is shut off. Accordingly, the compressed refrigerant gas in the compression chamber Pb of the cylinder bore 14A moves the discharge valve 32 to the opening position thereof to thereby be discharged toward the discharge chamber 24 via the discharge port 4c.

The above-described suction and discharge operation of the refrigerant gas carried out by the double-headed reciprocating-piston 15A in cooperation with the rotary valve elements 27 and 28 for the pair of cylinder bores 13A and 14a is identically realized by the other respective double-headed reciprocating-pistons 15 for the compression chambers P of the other pairs of cylinder bores 13 and 14 in cooperation with the rotary valve elements 27 and 28.

The drive shaft 7 having one end (a front end) outwardly projecting from the front housing 18 and the other end (a rear end) projecting into the rear discharge chamber 24 of the rear housing 19. The drive shaft 7 is centrally provided with an axial discharge passageway 37 opening toward the discharge chamber 24. The axial discharge passageway 37 centrally extends toward the front end thereof, and is communicated with the front side discharge chamber 23 via connecting parts 38 Namely, the front and rear discharge chambers 23 and 24 are mutually communicated via the discharge passageway 37 and the connecting ports 38. Consequently, the compressed refrigerant gas discharged in the discharge chamber 24 constantly flows into the discharge chamber 23.

From the foregoing description, it will be understood that the rotary valve elements 27 and 28 rotating with the drive shaft 7 are able to successively supply the plurality of pairs of cylinder bores 13, 14, 13A, and 14A with the refrigerant gas before compression without suffering from the aforementioned problems encountered by the conventional flapper type suction valves. Namely, the problems of delay of opening of the flapper type suction valves adversely affected by the lubricating oil attached to the valves, and the insufficient amount of suction of the refrigerant gas due to the resilience of the flapper type valves can be overcome by the rotary valve elements 27 and 28. The rotary valve elements 27 and 28 are able to permit the refrigerant gas before compression to immediately flow into the compression chambers Pa and Pb as soon as pressure level in the compression chambers Pa and Pb is below that prevailing in the swash plate chamber 11 in response to the reciprocation of the double headed pistons 15. Accordingly, the reciprocating piston type refrigerant compressor according to the first embodiment provided with the rotary valve elements 27 and 28 is able to exhibit an enhanced volumetric compression efficiency compared with the conventional compressor provided with the flapper type suction valves.

Further, since the refrigerant gas before compression in the swash plate chamber 11 is drawn into the compression chambers P (Pa and Pb) in respective pairs of cylinder bores 13, 14, 13A and 14A through the suction passageways 29 and 30 of the rotary valve elements 27 and 28, the front and rear cylinder blocks 1 and 2 do not need to have suction passageways as were provided in the cylinder blocks of the conventional reciprocating piston type compressor. Moreover, since the compressed refrigerant gas in the rear discharge chamber 24 of the compressor of the present embodiment is collected into the front discharge chamber 23 via the axial discharge passageway 37 of the drive shaft 7 and is delivered toward the external refrigerating circuit via the outlet port 25, the front and rear cylinder blocks 1 and 2 do not need to have discharge passageways.

The above mentioned omission of the suction and discharge passageways from the front and rear cylinder blocks 1 and 2 enables it to reduce angular spacing between the two circumferentially neighboring cylinder bores of the plurality of pairs of cylinder bores 13 and 14 in the front and rear cylinder blocks 1 and 2. Thus, it is possible to reduce the diameter of a circle along which the cylinder bores are arranged without reducing the bore diameter of respective cylinder bores 13, 14, 13A and 14A. Consequently, the diameter of cylinder blocks 1 and 2 can be reduced resulting in the reduction in the diameter and weight of the entire compressor.

Further, in the compressor of the first embodiment of the present invention, the refrigerant gas before compression can be quickly drawn into the compression chambers Pa and Pb of the pair of cylinder bores 13, 14, 13A and 14A as soon as the pressure level in the compression chambers becomes less than that in the swash plate chamber 11 during the reciprocation of the double headed reciprocating pistons 15, 15A via the shorter suction passageways 29 and 30 of the rotary valve elements 27 and 28 compared with the conventional compressor. Therefore, the flow resistance to which the refrigerant gas before compression is subjected during the suction process thereof can be small. Accordingly, pressure loss during the suction of the refrigerant gas can be appreciably reduced resulting in improving the compression efficiency of the compressor.

Furthermore, since the rotary valve elements 27 and 28 are provided with the tapered outer circumferences 27c and 28c capable of being in close contact with the slanted inner walls of the valve receiving chambers 1a and 2a, the refrigerant gas under high pressure does not leak from the discharge chambers 23 and 24 toward the swash plate chamber 11 through between the tapered outer circumferences 27c and 28c and the inner walls of the valve receiving chambers 1a and 2a during the operation of the compressor. Namely, the large diameter ends 27a and 28a of the rotary valve elements 27 and 28 are exposed to the discharge chambers 23 and 24, i.e., regions in which a high pressure of the compressed refrigerant gas prevails, and the small diameter ends 27b and 28b of the rotary valve elements 27 and 28 are directly exposed to the swash plate chamber 11 in which a low pressure of the refrigerant gas before compression prevails. Therefore, both rotary valve elements 27 and 28 rotating in the valve receiving chambers 1a and 2a are constantly urged toward respective positions where the tapered outer circumferences 27c and 28c thereof are in air tightly contact with the tapered inner walls of the valve receiving chambers 1a and 2a during the operation of the compressor. Thus, there occurs no leakage of the compressed refrigerant gas between the tapered outer circumferences 27c and 28c and the inner walls of the valve receiving chambers 1a and 2a.

The seal rings 39 and 40 are able to prevent the compressed refrigerant gas from leaking through between the rotary valve elements 27 and 28 and the drive shaft 7. At this stage, the rotary valve elements 27 and 28 and the drive shaft 7 are always rotated together, and accordingly, the seal rings 39 and 40 are not relatively rotated with respect to the valve elements 27 and 28 and the drive shaft 7. Thus, abrasion of the seal rings 39 and 40 does not occur.

From the foregoing, it is understood that, since the rotary valve elements 27 and 28 can completely prevent leakage of the compressed gas from the high pressure regions, i.e., the discharge chambers 23 and 24 toward the low pressure region, i.e., the swash plate chamber 11, the volumetric efficiency in the compression of the refrigerant gas performed by the compressor of FIGS. 1 through 7, can be improved.

It should also be appreciated that as the rotary valve elements 27 and 28 are incorporated in the compressor by only inserting the elements onto the raised portions 7*a* and 7*b* of the drive shaft 7, the assembly of the rotary valve elements can be simpler than in the case of the conventional flapper type valves resulting in making the operation of assembly of the entire compressor simpler.

Moreover, the rotary valve elements 27 and 28 provided with the tapered outer circumference 27*c* and 28*c* are constantly maintained in air tight contact with the valve receiving chambers 1*a* and 2*a* provided with the complementary tapered inner walls by using a pressure differential between pressures of the compressed refrigerant gas and that of the refrigerant gas before compression. Thus, even if the tapered outer circumferences 27*c* and 28*a* and the complementary tapered inner walls of the valve receiving chambers are frictionally worn out during the long operation of the compressor, the air-tight contact between the tapered outer circumferences 27*c* and 28*a* of the valve elements 27 and 28 and the tapered inner walls of the valve receiving chambers 1*a* and 2*a* is not changed. The unchanged air tight contact between the two valve elements and the corresponding chambers can be obtained even if the coefficient of linear expansion of the valve elements 27 and 28 is different from that of the cylinder blocks 1 and 2. Thus, the rotary valve elements 27 and 28 can guarantee fluid isolation of the high pressure discharge chambers 23 and 24 from the low pressure swash plate chamber 11. A change in the temperature inside the compressor does not adversely affect on the air tight sealing function of the rotary valve elements 27 and 28, and eventually, the rotary valve elements 27 and 28 may be made of known various plastic materials.

According to the above-described structure of this embodiment, since the lubricant passages 77*d* and 78*d* are formed in the rotary valve elements 27 and 28 respectively, the lubricant oil is sufficiently supplied to the circumferences 27*c* and 28*c* of both rotary valve elements 27 and 28 through the lubricant passages 77*d* and 78*d* even when both rotary valve elements 27 and 28 are continuously urged against the receiving chambers 1*a* and 2*a*, respectively. Therefore, lubrication of the circumferences 27*c* and 28*c* is sufficiently achieved, such that wear of the rotary valve elements can be significantly minimized.

Figure 8:
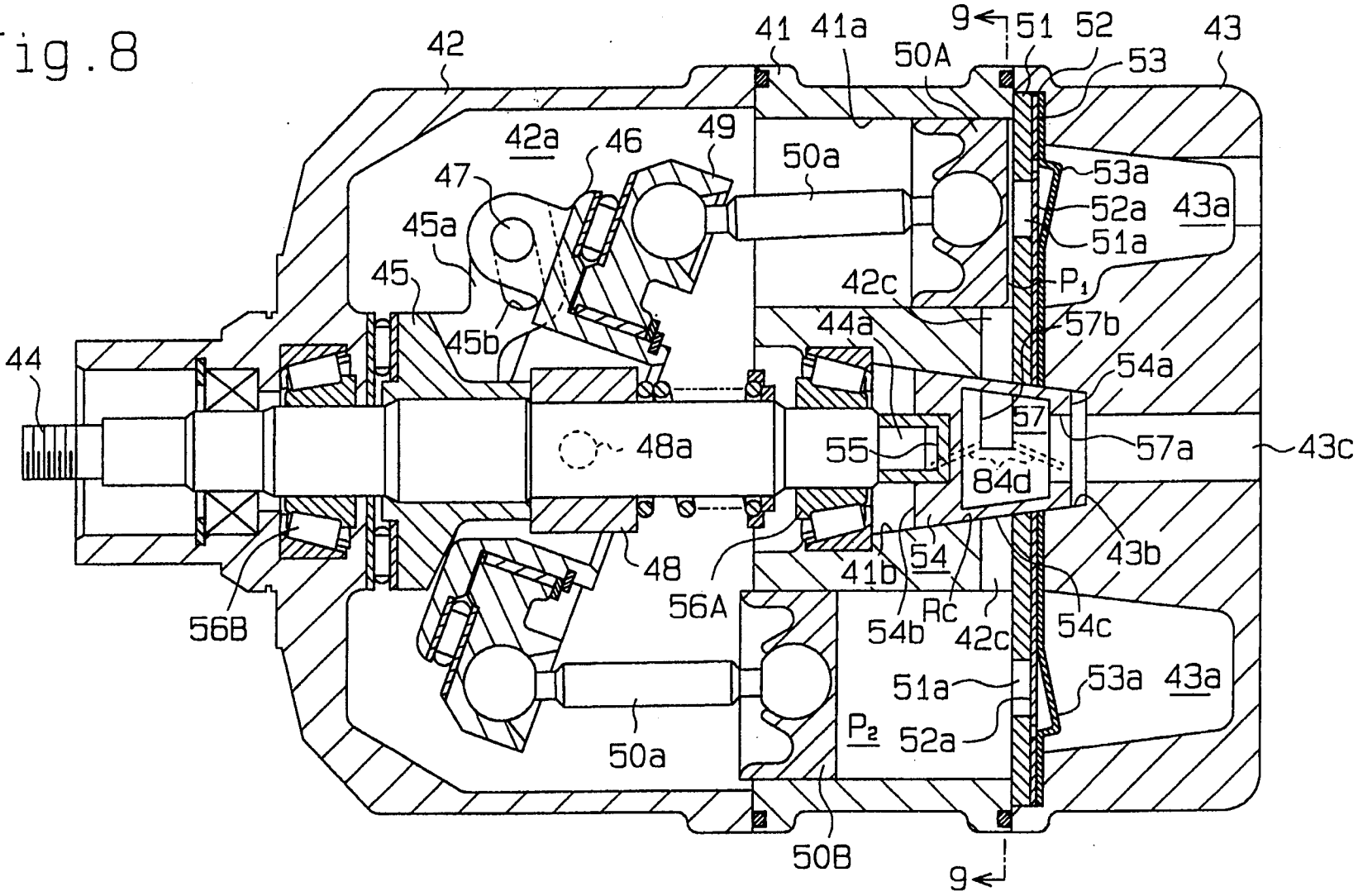
FIG. 8 is a longitudinal cross sectional view of an entire compressor according to a second embodiment of the present invention.
Figure 9:
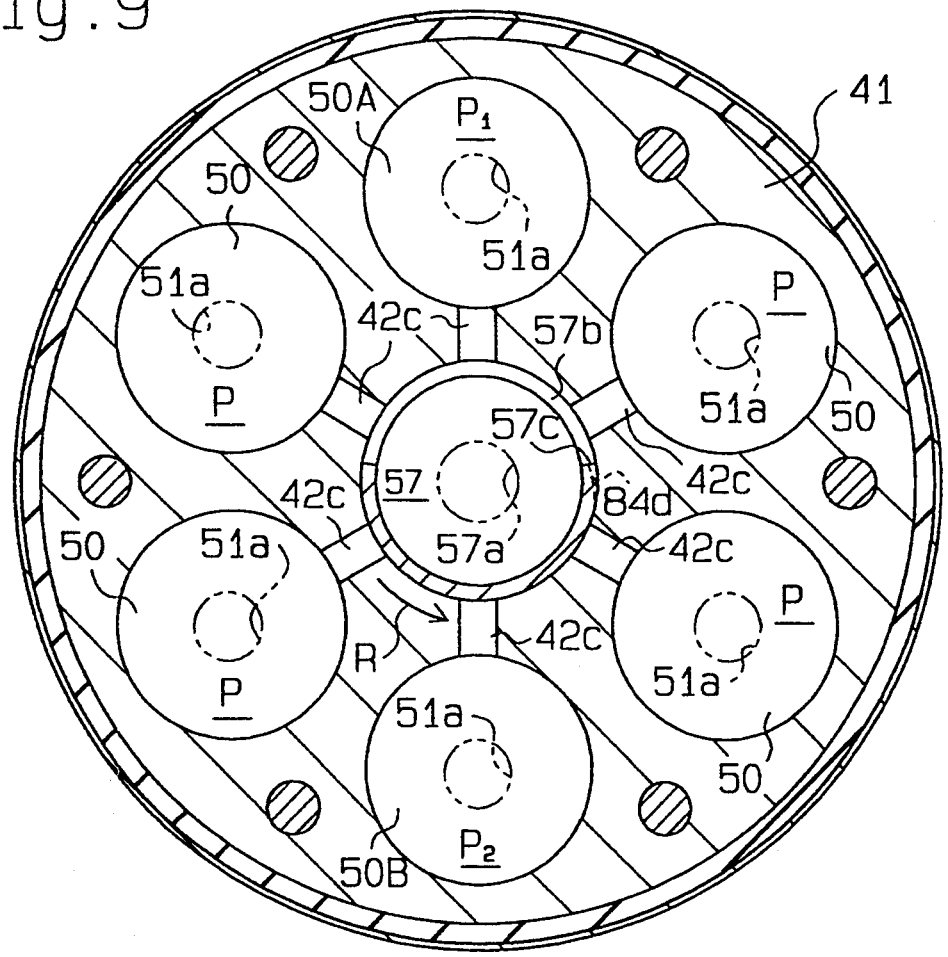
FIG. 9 is a cross sectional view of the compressor taken along the line IX—IX of FIG. 8.
Figure 10:
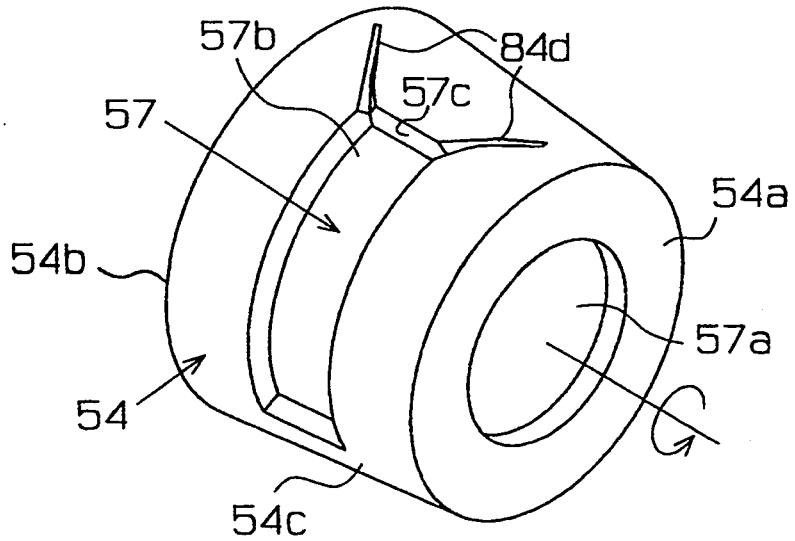
FIG. 10 is a perspective view of a rotary valve element incorporated in the compressor of FIG. 8.

FIGS. 8 through 10 illustrate the second embodiment of the present invention in which the reciprocating piston type refrigerant compressor is a variable displacement wobble plate type refrigerant compressor having a plurality of reciprocating pistons.

In FIG. 8, the compressor includes a compressor body constituted by a cylinder block 41, and front and rear housings 42 and 43, and an axial drive shaft 44 rotatably supported by tapered-roller bearings 56A and 56*s* mounted in the cylinder block 41 and the front housing 42 of the compressor body.

A rotary support member 45 fixedly mounted on the drive shaft 44 is connected to a rotary drive member 46 via an arm 45*a* having an elongated through-hole 45*b* in which a pin 47 held by the rotary drive member 46 is movably engaged. The rotary drive member 46 is inclinably pivoted on trunnion pins 48*a* laterally projecting from a guide sleeve 48 which is mounted on the drive shaft 44 to be axially slidable. The rotary drive member 46 supports thereon a non-rotatable wobble plate 49 via a thrust bearing and an annular slide bearing fitted on a cylindrical flange portion of the drive member 46.

The wobble plate 49 is operatively connected to a plurality of reciprocatory single-headed pistons 50, 50A, 50*s* slidably received in a corresponding number of cylinder bores 41*a* (six bores in the shown embodiment) via respective connecting rods 50*a*.

The rotation of the drive shaft 44 is converted into a nutational motion of the wobble plate 49 about the trunnion pins 48*a* via the rotary support and drive members 45 and 46. Thus, the nutation of the wobble plate 49 causes reciprocation of the plurality of single-headed pistons 50, 50A, 50B in respective cylinder bores 41*a*.

A valve plate 51, a valve forming plate 52, and a retainer plate 53*a* are arranged between the rear end of the cylinder block 41 and the rear housing 43 in a tightly fixed condition. The rear housing 43 has an angularly extending discharg chamber 43*a* defined therein and fluidly communicated with compression chambers P, P1, P, formed in respective cylinder bores 41*a* via discharge ports S1*a* provided in the valve plate 51. Discharge reed valves 52*a* formed in the valve forming plate 52 are arranged so as to openably close the discharge ports 52*a* at the side thereof confronting the discharge chamber 43*a*. The retainer plate 53*a* is arranged for determining an amount of opening of the discharge reed valves 52*a*.

The above-described compressor body has a valve receiving chamber Rc formed by two contiguous bore-like chambers 41*b* and 43*b*. The former chamber 41*b* is centrally formed in the rear end portion of the cylinder block 41, and the latter chamber 43*b* is centrally formed in the end portion of the rear housing 43. A rear end 44*a* of the drive shaft 44 is projected into the chamber 41*b* of the valve receiving chamber Rc.

The valve receiving chamber Rc is generally formed as an axially convergent conical chamber having a small diameter portion thereof at the rearmost end of the chamber 43*b*, and a large diameter portion thereof at the frontmost end of the chamber 41*b*. Within the valve receiving chamber Rc is arranged a rotary valve element 54 having a conically tapered outer circumference 54*c* complementary with an inner tapered wall of the valve receiving chamber Rc.

As clearly shown in FIG. 8, a rear small diameter end 54*a* of the rotary valve element 54 confronts the rearmost end of the tapered chamber 43*b* via a small spacing therebetween. A large diameter end 54*b* of the rotary valve element 54 is connected to the rear end 44*a* of the drive shaft 44 via a coupling member 55 fitted in a central hole of the large diameter end 54*b*. The rear end 44*a* of the drive shaft 44 is fitted in the coupling member 55 in a non-rotatable manner but in an axially slidable manner. The rotary valve element 54 can rotate in the valve receiving chamber Rc in a predetermined direction shown by an arrow R in FIG. 9.

The rotary valve element 54 is provided with a cavity-like suction passageway 57 having an inlet 57*a* formed in the small diameter end 54*a* located in the chamber 43*b* of the rear housing 43, and an outlet 57*b* formed in the tapered outer circumference 54*c* at a position adjacent to the large diameter end 54*b*. The inlet 57*a* of the suction passageway 57 is communicated with an inlet port 43*c* of the rear housing 43 provided for introducing refrigerant gas from an external refrigerating circuit. The inlet port 43*c* in the form of an axial bore formed in the center of the rear housing 43 so as to be contiguous with the chamber 43*b* of the valve receiving chamber Rc. Thus, the refrigerant gas returning from the external refrigerating circuit is constantly introduced into the suction chamber 57 of the rotary valve element 54. The outlet 57*b* of the suction passageway 57 has the form of a circumferential aperture as best shown in FIG. 10.

A plurality of suction ports 41*c*, the number of which is identical with that of cylinder bores 41*a* , are provided in the cylinder block 41 so as to be arranged around the chamber 41*b* of the valve receiving chamber Rc at an equal angular spacing. Each of the suction ports 41*c* radially extends, and has an inner end opening in the inner wall of the valve receiving chamber Rc, and being able to be cyclically communicated with the suction passageway 57 via the circumferential outlet 57*b*.

In FIGS. 8 and 9, the piston 50A is moved to a position corresponding to a tap dead center thereof in the corresponding one of the cylinder bores 41*a*, and the piston 50B angularly spaced apart 180° C. from the piston 50A is moved to a position corresponding to a bottom dead center thereof in the corresponding one of the cylinder bores 41*a*. When the refrigerant gas is drawn in the compression chambers P, P1, P2, it is compressed in respective cylinder bores 41*a* by the pistons 50, 50A, 50B during the compression stroke of the pistons moving from the bottom dead center thereof toward the top dead center thereof. The compressed refrigerant gas is discharged from the compression chambers P, P1, P2 toward the discharge chamber 43*a* of the rear housing 43 at the final stage of the compression stroke of respective reciprocating pistons 50, 50A, 50B.

As is well known, in the variable displacement wobble plate type refrigerant compressor, the extent of the stroke of the respective pistons 50, 50A, 50B is changed in response to a change in a pressure differential between pressure prevailing in a crank chamber 42*a* of the front housing 42 and pressure prevailing in the discharge chamber 43*a* of the rear housing 43. The change in the extent of the stroke of the respective pistons 50, 50A, 50B causes a change in an angle of inclination of the wobble plate 49 with respect to a plane perpendicular to the axis of rotation of the drive shaft 44, and accordingly, the displacement of the compressor is varied. When the pressure level in the crank chamber 42*a* is controlled, the change in the above-mentioned displacement of the compressor can be adjustably changed, and the control of the pressure level in the crank chamber 42*a* can be achieved by supplying a high pressure refrigerant gas into the crank chamber 42*a* and by appropriately evacuating the refrigerant gas from the crank chamber 42*a* toward a suction pressure region, i.e., a region directly communicated with the inlet port 43*c* via a known displacement control valve mechanism (not shown in FIGS. 8 through 10).

The crank chamber 42*a* of the front housing 42 is constantly maintained at a pressure level higher than that in the suction pressure region.

During the operation of the compressor, the pressure prevailing in the crank chamber 42*a* acts on the large diameter end 54*b* of the rotary valve element 54, and the pressure prevailing in the inlet port 43*c* acts on the small diameter end 54*a* of the same element 54. Therefore, the rotary valve element 54 rotating in the valve receiving chamber Rc is axially pressed and moved in the valve receiving chamber Rc toward the rear end of the compressor body. Accordingly, the conical outer circumference 54*c* of the rotary valve element 54 is pressed against the tapered inner wall of the valve receiving chamber Rc, i.e., the tapered inner wall of, the chambers 41*b* and 43*b*. Therefore, leakage of the refrigerant gas from the high pressure crank chamber 42*a* toward the low pressure inlet port 43*c* does not occur.

As shown in FIG. 10, a pair of lubricant passages 84*d* are formed in the outer circumference 54*c* of the rotary valve element 54 similar to the first lubricant passages 77*d* of the first embodiment. The lubricant passages 84*d* are slanted, and one of the passages 84*d* extends in the direction of rotation from the end surface 57*c* of the outlet 57*b* of the suction passage 57 to the large diameter end portion 54*b*, and the other to the small diameter end portion 54*a* of the rotary valve element 54. Consequently, according to this embodiment, the lubricant oil is sufficiently supplied to and between the circumference of the rotary valve element 54 and the inner walls of receiving chamber 41*b* and 43*b* through the lubricant passages 84*d*, similar to the first embodiment. Therefore, the rotary valve element 54 can smoothly rotate, and wear of the valve 54 and inner walls of the chambers 41*b* and 43*b* can be significantly minimized.

A description of the third embodiment of the present invention will be provided below with reference to FIG. 11 in which elements and parts substantially identical with those of the first embodiment are designated by the same reference numerals and characters used with the first embodiment.

Figure 11:
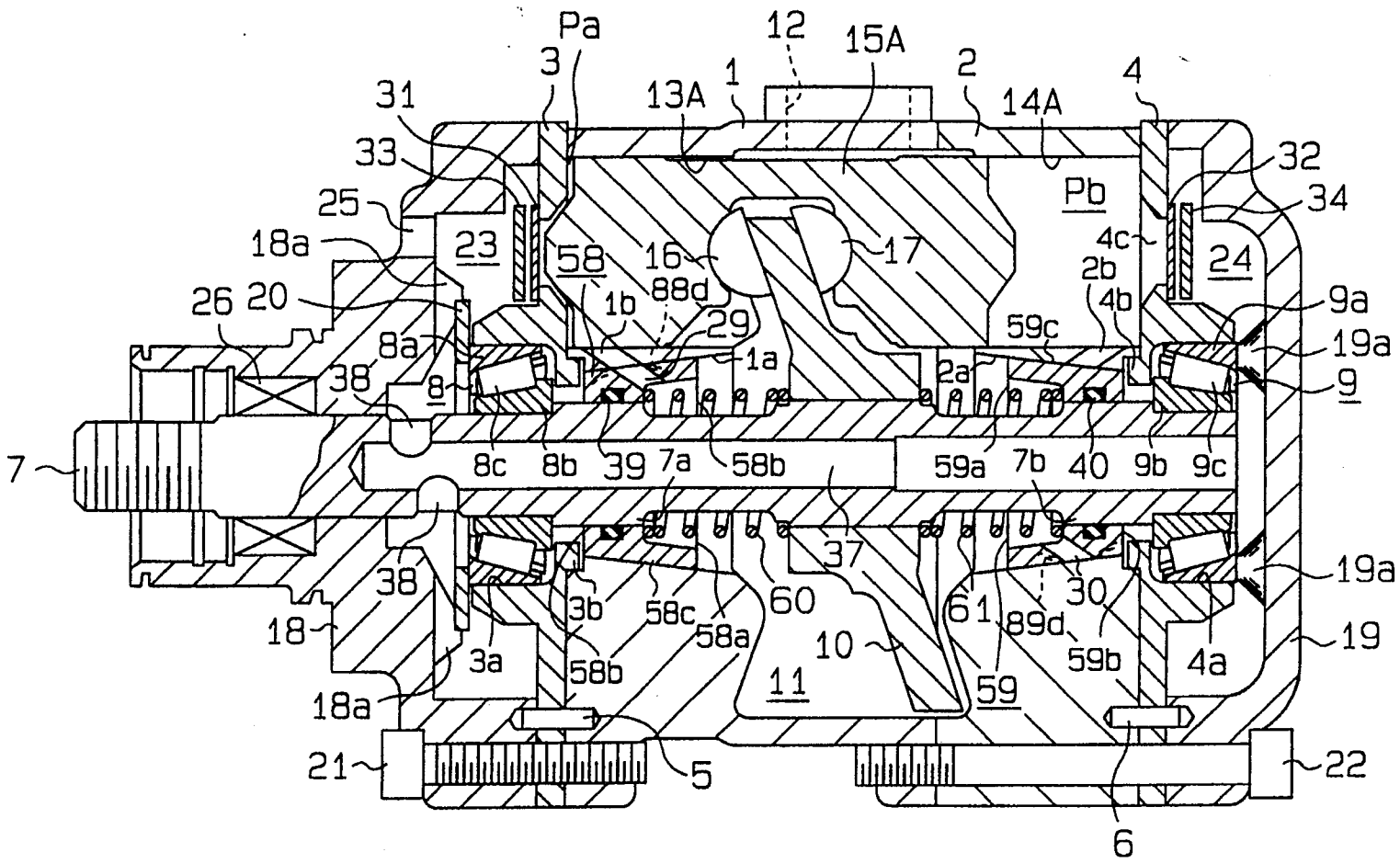
FIG. 11 is a longitudinal cross sectional view of an entire compressor according to a third embodiment of the present invention.

In FIG. 11, the reciprocating-piston type refrigerant compressor is formed as a swash plate type compressor having an internal construction substantially the same as the compressor of FIG. 1. Thus, the compressor of the third embodiment is provided with a plurality of double headed reciprocating pistons 15A, a corresponding number of pairs of front and rear cylinder bores 13A, 14A for receiving the double headed pistons 15A, and a swash plate 10 mounted on a rotatable drive shaft 7 so as to be rotated in a swash plate chamber 11 which functions to receive refrigerant gas introduced from an external refrigerating circuit via an inlet port 12. The compressor is also provided with a pair of front and rear rotary valve elements 58 and 59 with tapered outer circumferences 58*c* and 59*c*, respectively. The rotary valve elements 58 and 59 are mounted on raised portions 7*a* and 7*b* of the drive shaft 7 so as to be rotated together, and received in bore like valve receiving chambers 1*a* and 2*a* of the front and rear cylinder blocks 1 and 2.

The valve receiving chambers 1*a* and 2*a* are, however, provided with conical inner walls axially outwardly converging, respectively. Namely, the direction of slanting of the valve receiving chambers 1*a* and 2*a* is contrary to that with the first embodiment of FIG. 1. Therefore, pressure of the refrigerant gas prevailing in a suction pressure region, i.e., in the swash plate chamber 11, acts on large diameter ends 58*a* and 59*a* of the respective rotary valve elements 58 and 59, and pressure of the refrigerant gas in front and rear discharge chambers 23 and 24 acts on small diameter ends 58*b* and 59*b* thereof.

In the third embodiment, a pair of springs 60 and 61 are incorporated in the rotary valve elements, respectively, which provide the valve elements 58 and 59 with pressure urging the elements in the axially outward directions, respectively. Namely, the springs 60 and 61 constantly urge both valve elements 58 and 59 toward their positions in sealing contact with the inner walls of the valve receiving chambers 1*a* and 2*a*.

The tapered outer circumferences 58*c* and 59*c* of the rotary valve elements 58 and 59 are provided with lubricant passageways 58*d* and 59*d*, formed therein as grooves similar to the grooved lubricant passageways 77*d* and 78*d* of the rotary valve elements 27 and 28 of the first embodiment. These first and second lubricant passageways 58*d*, 59*d*, 58*e* and 59*e* lubricate the tapered outer circumferences 58*c* and 59*c* of the rotary valve elements 58 and 59, and the inner walls of the valve receiving chambers 1*a* and 2*a* with mist-like or liquid oil contained in the refrigerant gas during the operation of the compressor.

Each of the springs 60 and 61 is designed and formed so as to be capable of exhibiting an elastic force overcoming pressure differential between pressures acting on both ends of each of the respective rotary valve elements 58 and 59 so that the rotary valve elements 58 and 59 are constantly urged toward the positions in sealing contact with the inner cells of the respective valve receiving chambers 1*a* and 2*a*. That is, the spring force of the respective springs 60 and 61 is predetermined so as to be larger than the pressure differential between opposing pressures of the refrigerant gas acting on the large and small diameter ends 58*a*, 59*a*, 58*b* and 59*b* of the rotary valve elements 58 and 59, respectively. The spring force of the respective springs 60 and 61 should be, however, adjusted so as to prevent the valve elements 58 and 59 from being excessively forced against the inner walls of the valve receiving chambers 1*a* and 2*a* to thereby ensure smooth rotation of the rotary valve elements 58 and 59.

Figure 12:
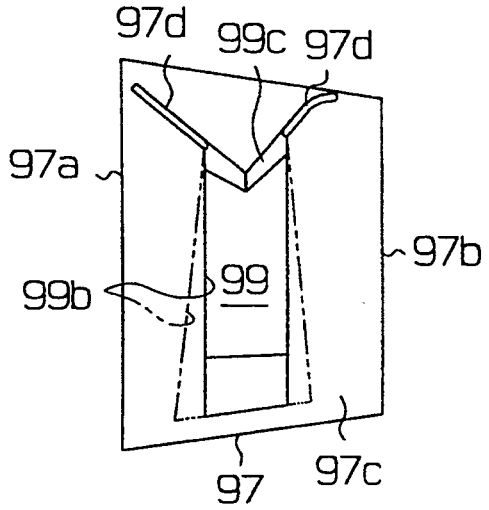
FIG. 12 is a front view showing another example of the rotary valve element.

FIG. 12 illustrates a modified arrangement of a rotary valve element in the corresponding valve receiving chamber of a reciprocating piston type refrigerant compressor.

However, the spring can be adapted to the wobble plate type compressor shown in FIGS. 8 and 9. Although only three embodiments of the present invention have been described in detail herein, it should be apparent to those skilled in the art that the present invention may be embodied in many other specific forms without departing from the spirit or scope of the invention. Particularly, it should be understood that the following modifications without limitation are within the teachings of the invention.

(1) FIG. 12 shows an alternative arrangement of the first embodiment. A central portion of an end surface 99*c* of an outlet 99*b* in a suction passage 99 projects inward within outlet 99*b*, and then the end surface 99*c* is angled to form a mountain like shape. Enhanced flow of the lubricant oil gathered in the suction passage 99 is directed into lubricant grooves 97*d*. The lubricant grooves 97*d* have the same configuration as that of the first embodiment. The outlet 99*b* can be formed as a tapered shape where the width thereof decreases as it approaches toward the end surface 99*c*, as shown by a broken line in FIG. 12. If this structure is employed, the lubricant oil can be effectively gathered into the suction passage.

Figure 13:
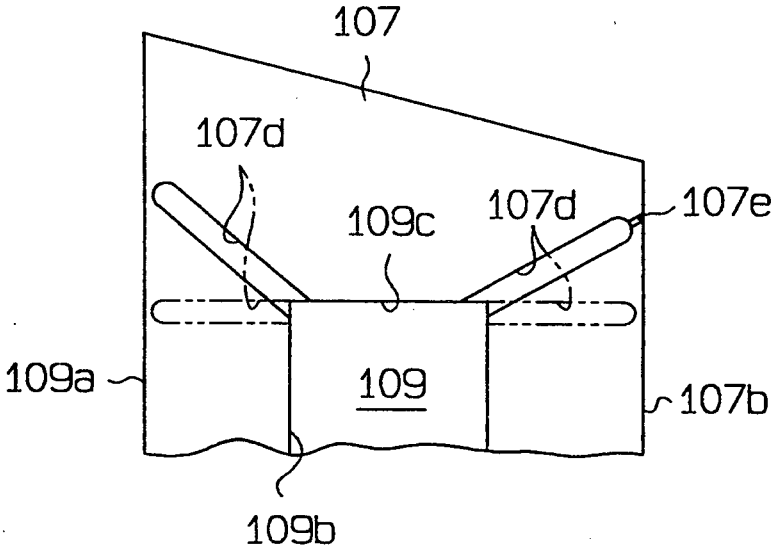
FIG. 13 is a partial front view showing yet another example of the rotary valve element.

(2) FIG. 13 shows an alternative arrangement of the first embodiment, which is shown by a solid line. A pair of lubricant grooves 107*d* are provided on a circumference of a rotary valve element 107 having substantially the same structure as the rotary valve elements 27 and 28 in the first embodiment. An auxiliary lubricant groove 107*e* is formed at the tip portion of one of the lubricant grooves 107*d* which is located at the swash plate chamber side. The auxiliary lubricant groove 107*e* has an extremely narrow width in comparison to that of a major portion of the lubricant grooves 107*d*. The lubricant oil can be supplied to a circumference of a small diameter end portion 107*b* of the rotary valve element 107. The area of the circumference of the rotary value element where the lubricant oil is supplied can be increased. Further, the lubricant grooves 107*d* can be formed in parallel to an end surface 109*c* of the suction passage 109. If this structure is employed, manufacturing process thereof can be simplified.

(3) The outer circumference of the rotary valve element can be formed in a cylindrical shape where the axis line of the drive shaft 7 is the center thereof. The inner circumference of the receiving chamber can be formed so as to correspond to the outer circumference of the rotary valve element. If this structure is employed, manufacturing process of the rotary valve element can be simplified.

Therefore, the present examples and embodiments are to be considered as illustrative and not restrictive and the invention is not to be limited to the details given herein, but may be modified within the scope of the appended claims.

What is claimed is:

1. A piston type compressor provided with a body, a drive shaft rotatably supported in the body, at least one gas receiving chamber formed in the body for receiving refrigerant gas mixed with lubricant oil before compression, at least one gas discharge chamber formed in the body for receiving compressed refrigerant gas, a plurality of axial cylinder bores formed in the body and arranged around an axis of rotation of the drive shaft, and a plurality of pistons slidably received in the plurality of cylinder bores and reciprocable in response to the rotation of the drive shaft, the pistons defining compression chambers in the cylinder bores, comprising:

a rotary valve means arranged to be rotatable with said drive shaft and having an outer peripheral wall and opposing end portions;

a recessed chamber disposed in the compressor body for receiving said rotary valve means, said recessed chamber being surrounded by an inner wall extending around the axis of rotation of said drive shaft, said outer peripheral wall of the rotary valve means being slidably disposed against the inner wall of said recessed chamber;

a suction passageway formed in the rotary valve means for permitting suction of the refrigerant gas before compression from the gas receiving chamber into the respective compression chambers in timed relationship with the reciprocation of said pistons during rotation of said rotary valve means, the suction passageway having an inlet communicating with the gas receiving chamber and an outlet located on the outer peripheral wall of said rotary valve means for communication with the compression chambers; and a groove disposed in the outer peripheral wall of the rotary valve means, said groove being connected with said outlet of the suction passageway and extending in the direction of rotation toward one of said opposing ends of the rotary valve means along said outer circumferential wall, said groove supplying said lubricant oil within the refrigerant gas in the suction passageway to and between the outer peripheral wall of the rotary valve means and the inner wall of the recessed chamber during rotation of the rotary valve means.

2. A piston type compressor according to claim 1, wherein said outer peripheral wall of said rotary valve means is tapered so that said opposing ends of said rotary valve means form small and large diameter end portions.

3. A piston type compressor according to claim 2, further comprising urging means for providing generally axial force on said rotary valve means thereby urging said rotary valve means in a direction such that said outer peripheral wall of said rotary valve means is in sealing contact with said inner wall of said recessed chamber.

4. A piston type compressor according to claim 3, wherein said urging means comprises a pressure applying means for applying pressure of said refrigerant gas to said small and large diameter and portions of the rotary valve means, a pressure differential between said small and large diameter end portions urging said rotary valve means in a direction such that said outer peripheral wall of said rotary valve means is in sealing contact with said inner wall of said recessed chamber.

5. A piston type compressor according to claim 4, wherein said pressure applying means supplies first and second gas pressures of the refrigerant gas, said first gas pressure being that before compression and said second gas pressure after compression of the refrigerant gas, respectively.

6. A piston type compressor according to claim 5, wherein said second pressure of the refrigerant gas is axially applied to said large diameter end portion of said rotary valve means and said first pressure of the refrigerant gas is axially applied to said small diameter end portion of the rotary valve means.

7. A piston type compressor according to claim 3, wherein said urging means comprises a spring.

8. A piston type compressor according to claim 7, wherein said small diameter end portion faces said gas receiving chamber, said large diameter end portion faces said compressed gas discharge chamber, and wherein said urging force of said spring is added to the force of the pressure differential between said pressure of the refrigerant gas before compression acting on said small diameter end portion and said pressure of the compressed gas acting on said large diameter portion, to provide a resultant force that urges the rotary valve means in a direction to bias said peripheral wall of said rotary valve in sealing contact with said inner wall of said recessed chamber.

9. A piston type compressor according to claim 7, wherein said large diameter end portion faces said gas receiving chamber, said small diameter end portion faces said gas discharge chamber, and said spring urges said rotary valve means in the axial direction thereof from the large diameter end portion to the small diameter end portion by a predetermined urging force larger than the force of the pressure differential between said pressure of the refrigerant gas before compression acting on said large diameter portion and said pressure of the compressed gas acting on said small diameter portion of said rotary valve means.

10. A piston type compressor according to claim 1, wherein said compressor is a fixed displacement wobble plate operated reciprocating piston type compressor, and wherein said gas receiving chamber is a swash plate chamber for receiving a swash plate and having a gas inlet port capable of communicating with an external refrigerating circuit.

11. A piston type compressor according to claim 1, wherein said compressor is a variable displacement wobble plate operated piston type compressor, and wherein said gas receiving chamber has a refrigerant inlet port formed in the body so as to introduce said refrigerant gas from an external refrigerating circuit thereof.

12. A piston type compressor according to claim 1, wherein said outlet of said suction passageway has a front end surface and a rear end surface located at the front side and the rear side with respect to the rotational direction of the rotary valve means, and wherein said groove extends obliquely outwardly toward the vicinity of one of the opposing ends from the rear end surface of said outlet.

13. A piston type compressor according to claim 12, wherein said rear end surface of said outlet has a central portion which protrudes into the outlet, and wherein said groove connects to the base of said rear end surface of said outlet.

14. A piston type compressor according to claim 12, wherein said outer peripheral wall is provided with an auxiliary groove communicating with said groove and having a predetermined width narrower than that of said groove, and wherein said auxiliary groove opens towards one of said end portions of the rotary valve means.

15. A piston type compressor according to claim 12, wherein said outlet of the suction passageway has a predetermined width which gradually decreases in the rotational direction of the rotary valve means from the front side toward the rear side of the rotational direction.

* * * * *

UNITED STATES PATENT AND TRADEMARK OFFICE

CERTIFICATE OF CORRECTION

PATENT NO. : 5,370,506
DATED : December 6, 1994
INVENTOR(S) : T. Fujii et al

It is certified that error appears in the above-indentified patent and that said Letters Patent is hereby corrected as shown below:

On the cover page: Item [63] should read:
Continuation-in-part of Ser. No. 103,888, August 6, 1993, abandoned, which is a continuation-in-part of Serial No. 102,588, August 5, 1993, pat. 5,397,218, which is a continuation-in-part of Ser. No. 101,927, August 4, 1993, pat. 5,368,450, which is a continuation-in-part of Ser. No. 101,178, August 3, 1993, pat. 5,378,115.

UNITED STATES PATENT AND TRADEMARK OFFICE

CERTIFICATE OF CORRECTION

PATENT NO. : 5,370,506

DATED : December 6, 1994

INVENTOR(S) : T. Fujii et al

It is certified that error appears in the above-indentified patent and that said Letters Patent is hereby corrected as shown below:

Column 1, line 7, before "incorporated" delete "which is" and substitute --(now abandoned), which is a continuation-in-part of Application Serial No. 08/102,588 filed on August 5, 1993, Application Serial No. 08/101,927 filed on August 4, 1993, and Application Serial No. 08/101,178 filed on August 3, 1993, which are--; line 17 after "compressors" insert a comma --,--; line 20 after "compressor" insert a comma --,--; line 27, change "swash-plate" to --swash plate--; line 28 change "swash-plate" to --swash plate--; line 29, change "swash-plate" to --swash plate--; line 43, change "stroke" to --strokes--; line 45 change "center" to --centers--; same line change "center thereof" to --centers of their strokes--; line 47 change "stroke" to --strokes--; line 48, change "center" (both occurrences) to --centers--; line 54, before "arranged" insert --are--; line 58, change "a" to --the--; line 60 change "Namely" to --Thus--; line 62 change "stroke" to --strokes--.

UNITED STATES PATENT AND TRADEMARK OFFICE

CERTIFICATE OF CORRECTION

PATENT NO. : 5,370,506
DATED : December 6, 1994
INVENTOR(S) : T. Fujii et al

It is certified that error appears in the above-indentified patent and that said Letters Patent is hereby corrected as shown below:

Column 2, line 1, after "of" insert --the--; line 8 change "instant" to -- instantaneous--; line 19, change "attach" to --on--; line 25 change "position" to --positions--; line 29 change "flapper-type" to --flapper type--; same line change "suction-valves" to--suction valves--; line 33 change "a" to --the--; line 40 delete "made"; line 43 change "suction-valves" to --suction valves--; line 51, change "the" to --any--; line 54, change "a" to --the--; line 67 change "in" to --on--. line 40, change "small" to —lowered—.

UNITED STATES PATENT AND TRADEMARK OFFICE

CERTIFICATE OF CORRECTION

PATENT NO. : 5,370,506
DATED : December 6, 1994
INVENTOR(S) : T. Fujii et al

It is certified that error appears in the above-indentified patent and that said Letters Patent is hereby corrected as shown below:

Column 3, line 7, change "the" to --any--; line 25 after "into" insert --the--; line 26 change "A circumference" to --The peripheral surface--; line 27 after "slanted" insert --or tapered--; change "An" to --The--; change "a" to --the--; line 28 delete "also"; line 29 before "axially" insert --correspondingly--; same line change "along" to --in--; line 31, change "circumference" to --peripheral surface--; same line, after "wall" insert --surface--; line 33, change "a" (first occurrence) to --its--; same line, change "to a" to --towards its--; same line change "side thereof" to --end--;line 36 after "with" insert --the--; same line before "pistons" insert --the--; line 37 change "he" to --the--; line 39 change "circumference" to --periphery--; line 45 delete "or even catastrophic failure"; line 58 change "portion" to --portions--; line 59 change "circumference" to --periphery--; line 60 after "wall" insert --surface--.

UNITED STATES PATENT AND TRADEMARK OFFICE

CERTIFICATE OF CORRECTION

PATENT NO. : 5,370,506
DATED : December 6, 1994
INVENTOR(S) : T. Fujii et al

It is certified that error appears in the above-indentified patent and that said Letters Patent is hereby corrected as shown below:

Column 4, line 2 change "an" to --the--; line 8 change "circumferential" to --peripheral--; line 12 change "circumferentially" to --surface--; line 14 change "circumferential" to ---peripheral--; line 18 change "non compressed" to --uncompressed--; line 25 change "circumferential" to --peripheral--; line 26 change "circumferential" to --peripheral--; line 27 change "with" to --to--; line 28 change "a" to --the--; line 30 change "circumferential" to --peripheral--; line 32 change "circumferential" to --peripheral--; line 33 after "wall" insert --surface--; line 47 after "enlarged" insert --fragmentary--; line 52 change "IV-IV" to --4-4--; line 54 change "V-V" to --5-5--; line 56 change "VI-VI" to --6-6--; line 58 change "VII-VII" to --7-7--; line 63 change "IX-IX" to --9-9--.

UNITED STATES PATENT AND TRADEMARK OFFICE

CERTIFICATE OF CORRECTION

PATENT NO. : 5,370,506
DATED : December 6, 1994
INVENTOR(S) : T. Fujii et al

It is certified that error appears in the above-indentified patent and that said Letters Patent is hereby corrected as shown below:

Column 5, line 13, after "2a" insert --each--; line 14 delete ", respectively"; line 16 delete "an"; line 22, after "4a" insert --, each; line 23 delete ", respectively"; line 25 after "which" insert --project--; same line after "inwardly" delete "project"; line 52, change "port" to --ports---; line 61 change "an" to --the--; line 63 delete "out of the plurality of cylinder bores"; line 64 delete "13 and 14"; same line after "1" insert --and--; line 65 delete "addition to" ; line 66 after "respectively" insert --wherein the remainder of the plurality of cylinder bores are designated 13 and 14, respectively--; line 68 change "reciprocatory" to --reciprocable--.

Column 6, line 15 after "which" insert --project--; same line after "inwardly" delete "project"; line 35 change "Namely" to --Thus--; line 63 after "at" insert --the--.

UNITED STATES PATENT AND TRADEMARK OFFICE

CERTIFICATE OF CORRECTION

PATENT NO. : 5,370,506
DATED : December 6, 1994
INVENTOR(S) : T. Fujii et al

It is certified that error appears in the above-indentified patent and that said Letters Patent is hereby corrected as shown below:

Column 7, line 15, change "a" to --the--; line 26 change "cylindrical" to -- conical--; line 33 change "circumferences" to --surfaces--; line 36 change "Namely" to --Thus--; line 39 change "of a" to --at the--; line 41 change "of a" to --at the--; line 42 change "swash-plate" to --swash plate--; line 44 change "of a" to --at the--; line 46 change "of a" to --at the--; line 53 change "circumferences" to --surfaces--; line 56 change "a" to --the--; line 57 change "circumference" to --surface--; line 60 after "extends" insert --obliquely--; same line, change "end" to --corner--; line 67 after "3," insert --as--.

Column 8, line 1 change "circumference" to --surface--; line 2, 3, delete "of a rear end surface 29c"; line 7 change "circumference" to --surface--line 8, change "circumference" to --surface--; line 9 change "circumference" to --surface--; line 15 change "a" to --the--; same line change "circumference" to --surface--; line 21 change "circumference" to --surface--; line 22 change "circumference" to --surface--; line 34 change "a" to --the--.

UNITED STATES PATENT AND TRADEMARK OFFICE

CERTIFICATE OF CORRECTION

PATENT NO. : 5,370,506

DATED : December 6, 1994

INVENTOR(S) : T. Fujii et al

It is certified that error appears in the above-indentified patent and that said Letters Patent is hereby corrected as shown below:

Column 9, line 15 change "14a" to a--14A--; line 16 change "reciprocating-pistons" to --reciprocating pistons--; line 20 change "having" to --has--; same line change "a" to --the--; line 22 change "a" to --the--; line 29 change "Namely" to --Thus--; line 32 change "in" to --into--; line 28 after "38" insert period "."; line 42 change "Namely" to --Thus--; line 50 after "as" insert --the--; line 58 after "efficiency" insert --as--.

Column 10, line 10 change "it to reduce" to --the reduction of--; line 11, change "the" to --any--; line 14 change "a" to --the--; line 38 change "circumferences" to --surfaces--; line 40 change "slanted" to --correspondingly tapered--; line 43 delete "through"; line 44 change "circumferences" to --surfaces--; line 46 change "Namely" to --Thus--; line 57 change "circumferences" to --surfaces--; line 58 change "air tightly" to -- airtight--; line 62 change "circumferences" to --surfaces--; line 65 delete "through".

UNITED STATES PATENT AND TRADEMARK OFFICE

CERTIFICATE OF CORRECTION

PATENT NO. : 5,370,506
DATED : December 6, 1994
INVENTOR(S) : T. Fujii et al

It is certified that error appears in the above-indentified patent and that said Letters Patent is hereby corrected as shown below:

Column 11, line 12 delete "7"; line 15, after "compressor" insert --only--; line 16, after "by" delete "only"; line 21, change "circumferences" to --peripheral surfaces--; line 24, change "a" to --the--; line 25 change "pressures" to --the pressure--; line 27 change "circumferences" to --surfaces--; line 28, change "28a" to --28c--; line 29, delete "out"; line 31, change "circumferences" to --surfaces--; line 32, change "28a" to --28c--; line 44, delete "on"; line 52, change "circumferences" to --tapered surfaces--; line 57, change "circumferences" to --surfaces--; line 66 change "41." to --41--; line 68 change "tapered-roller" to --tapered rollers--.

Column 12, line 1 change "56s" to --56B--; line 14, change "operatively" to --operably--; line 15, change "reciprocatory" to -- reciprocable--; line 16 change "50s" to --50B--; line 30, "discharg" should read --discharge--; line 32, change "P" (second occurrence) to --P2--; line 33 change "S1a" to -- 51a--; line 38, change "an amount" to --the extent--; line 54, change "circumference" to --peripheral surface--.

UNITED STATES PATENT AND TRADEMARK OFFICE

CERTIFICATE OF CORRECTION

PATENT NO. : 5,370,506

DATED : December 6, 1994

INVENTOR(S) : T. Fujii et al

It is certified that error appears in the above-indentified patent and that said Letters Patent is hereby corrected as shown below:

Column 13, line 5, change "circumference" to --surface--; line 10 after "43c" insert --is--; line 20 change "41c" to --42c--; line 25 change "41c" to --42c--; line 49 change "a" to --the--; line 54 change "an" to --the--.

Column 14, line 12 change "circumference" to --surface--; line 20 change "circumference" to --peripheral surface--; line 23, change "slanted" to --oblique to the opening 57b--; line 25 change "to" to --towards--; line 26 change "to" to --towards--; line 29 change "circumference" to --peripheral surface--; line 56 change "circumferences" to --surfaces--; line 65 change "slanting" to --taper--; line 66 change "contrary" to --opposite--; same line change "with" to --of--.

Column 15, line 14 change "circumferences" to --surfaces--; line 20 change "58d, 59d, 58e and 59e" to --88d, 89d--; line 28 before "pressure" insert --the--; line 32 , delete "the" (first occurrence); line 32 change " cells" to --walls--. line 16, change "58d and 59d" to —88d and 89d—.

UNITED STATES PATENT AND TRADEMARK OFFICE

CERTIFICATE OF CORRECTION

PATENT NO. : 5,370,506
DATED : December 6, 1994
INVENTOR(S) : T. Fujii et al

It is certified that error appears in the above-indentified patent and that said Letters Patent is hereby corrected as shown below:

Column 16, line 7 change "a circumference" to --the periperhal surface--; line 15, change "a" to --the--; line 16 change "a circumference" to --the peripheral surface--; line 16, change "a" to --the--; line 18 change "circumference" to --surface--; line 20 after "107d" insert --indicated by dotted lines--; line 21, delete "in"; change "an" to --the--; line 22, after "employed," insert --the--; line 24 change "circumference" to --peripheral surface--; line 27 change "circumference" to --peripheral surface--; line 28 change "circumference" to --surface--; line 30 after "employed" insert --the--;

Column 17, line 29 after "diameter", "and" should read --end--; line 39 after "pressure" insert --being that--.

Column 18, line 28, after "the" insert —compressor—.

Signed and Sealed this

Twenty-second Day of October, 1996

*Attest:*

Bruce Lehman

BRUCE LEHMAN

*Attesting Officer*

*Commissioner of Patents and Trademarks*